United States Patent [19]

Shuey et al.

[11] 4,249,223

[45] Feb. 3, 1981

[54] HIGH VOLTAGE DC CONTACTOR WITH SOLID STATE ARC QUENCHING

[75] Inventors: Kenneth C. Shuey, Cridersville; Donal E. Baker, American Township, Allen County; Charles L. Doughman, Lima, all of Ohio

[73] Assignee: Westinghouse Electric Corp., Pittsburgh, Pa.

[21] Appl. No.: 965,558

[22] Filed: Dec. 1, 1978

[51] Int. Cl.[3] ..... H01H 9/30

[52] U.S. Cl. ..... 361/4; 361/6

[58] Field of Search ..... 361/4, 6

[56] References Cited

U.S. PATENT DOCUMENTS

| | | | |
|---|---|---|---|
| 2,789,253 | 4/1957 | Vang | 361/4 |
| 2,958,808 | 11/1960 | Miller | 361/4 |
| 3,708,718 | 1/1973 | Hoffmann et al. | 361/4 |
| 3,818,311 | 6/1974 | Mattson et al. | 361/4 |

*Primary Examiner*—J. D. Miller
*Assistant Examiner*—L. C. Schroeder
*Attorney, Agent, or Firm*—G. H. Telfer

[57] ABSTRACT

An arc quenching circuit senses initiation of an arc across the contacts of a contactor, commutates a capacitor discharge to the contacts that brings the contact voltage to zero for arc extinction and promptly recharges the capacitor to enable reoperation.

5 Claims, 4 Drawing Figures

HIGH VOLTAGE DC CONTACTOR WITH SOLID STATE ARC QUENCHING

BACKGROUND OF THE INVENTION

This invention relates to DC contactors for electrical systems.

Generally available high voltage DC contactors, for operation at voltage levels up to at least about 300 volts are electromechanical devices that use mechanical blowout mechanisms for extinguishing the arc that results from opening the contacts. Arc extinction can be particularly important when interrupting current flow to inductive loads, or resistive loads where the conductive leads themselves provide substantial inductance. The blowout mechanisms are inherently large, heavy, and slow and entail a relatively long arcing time upon opening.

High voltage DC power systems are of present interest for use in aircraft because of improved distribution efficiency and elimination of the constant speed drive required for 400 Hz systems, as have been conventional. In applications such as aircraft systems, size and weight are of extreme importance and load transients and power dissipation must be minimized.

It is possible to avoid arcing altogether by making DC contactors utilizing solid state components, for example transistors, as the switching elements in avoiding the use of any mechanical contacts. At present, however, such DC contactors are considered feasible only at modest current levels, such as less than about 50 amperes. When higher steady state currents are encountered, the power dissipation and heating in the solid state componets gets quite large. On the other hand, electromechanical relays offer the advantage of providing high current switching with minimum dissipation in the steady state, that is, when the relay is on and the contacts are closed.

The present invention seeks the objectives of a DC contactor with high current and voltage handling capability where arc quenching is rapid and achievable by minimal size and weight components.

In part, the objectives of this invention have been addressed by the prior art. For example, U.S. Pat. No. 3,309,570, Mar. 14, 1967, is directed to an arcless interruper wherein an electromechanical contactor is provided with a circuit for diverting current away from the contacts upon opening and imposing a reverse voltage across the contacts. Such apparatus is intended to avoid creation of any arc, not to rapidly quench an arc upon its initiation. Such apparatus of the prior art has characteristics impairing performance. Speed of operation, bi-directional capability, and avoidance of substantial voltage transients to the load are among the qualities desirably improved.

SUMMARY OF THE INVENTION

Briefly, in accordance with the present invention, the power contacts are connected across each of two full wave rectifier bridges. One of the full wave bridges, the commutation bridge, insures a working current to the arc quenching circuit for proper functioning upon either positive or negative current flow in the power contacts. The other full wave bridge, called the signal bridge, allows the detection circuitry to function properly independent of which power terminal is the input (supply +) (contact voltage polarity) or which current polarity is applied.

Arc detection occurs when the signal bridge has an output above a certain threshold and that signal is applied to gates of switching devices such as SCR's in a selective manner to commutate the load energy out of the electromechanical contacts long enough to ensure that a reapplied voltage will not reignite the arc.

A significant part of the commutation circuitry is a "commutation ready" portion of the circuit that ensures full commutation capability for the next contact opening. A logic circuit waits until commutation is complete to energize the charge circuit to bring the commutation energy back to the level prior to opening.

The full wave commutation bridge ensures the line voltage to the load is not increased by the arc quenching function. This is in contrast to the above-mentioned patent in which the apparatus causes commutation of energy into the load circuit that necessarily entails a doubling of the line voltage as seen by the load. Also, the commutation ready, or recharging, circuit portion is one that provides prompt switching of line voltage to recharge the commutation capacitor rather than using a trickle charge through a resistor as does the above patent.

DESCRIPTION OF THE PREFERRED EMBODIMENTS

Figure 1:
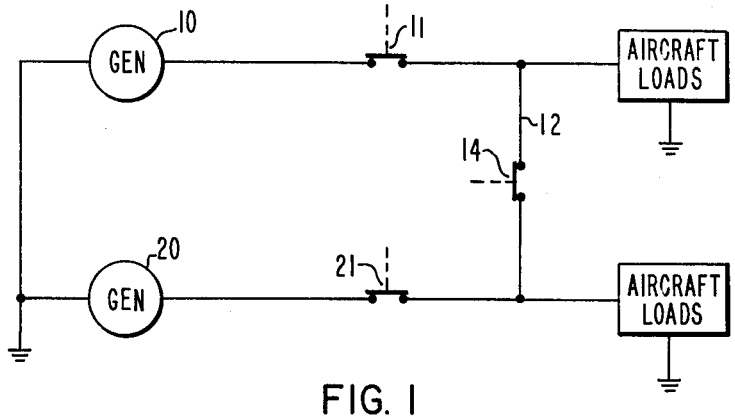
FIG. 1 is a schematic diagram of an exemplary system to which the present invention may be applied.

FIG. 1 shows an example of a general type of electrical system, such as for aircraft, in which the present invention is advantageously used. Two DC generators 10 and 20 are paralleled to a power bus 12 for supplying various loads where high voltage circuit breakers or contactors are required in each of the paralleled generator channels (represented by contactors 11 and 21) and also in the power bus (contactor 14). Such systems are typical of those for use on aircraft where minimal size and weight are desired and load transients are to be minimized. In a parallel generator system, a fault may occur which could cause current to flow in either direction through the system contactors. Also, the voltage polarity on the contactors could be undefined, making bipolar operation a requirement. It will be apparent that the utility of the present invention can be extended to systems of a character other than that of FIG. 1 in accordance with the skill of the art.

Figure 2:
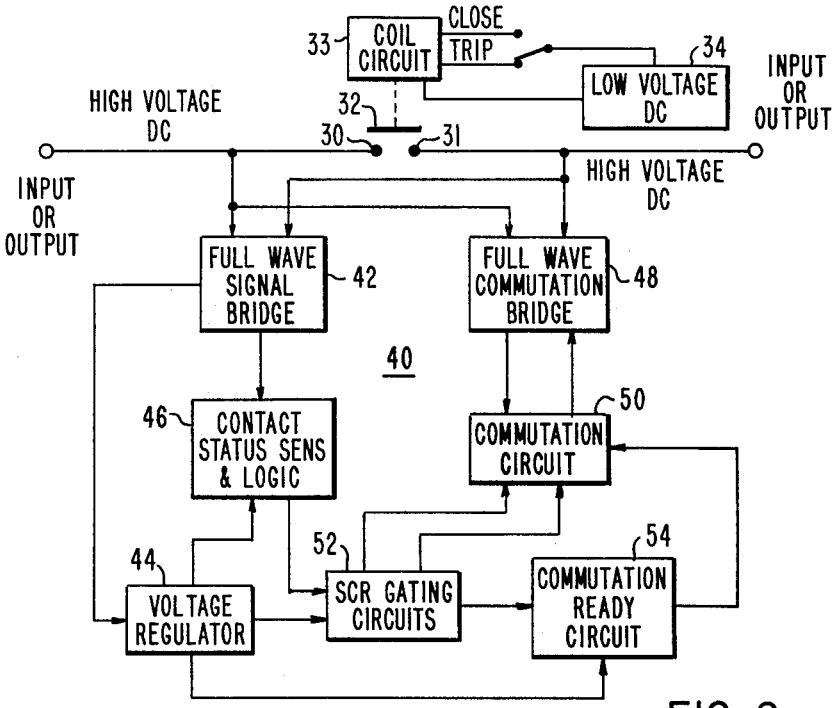
FIG. 2 is a schematic block diagram of a contactor and arc detection and quenching circuitry in accordance with an embodiment of the present invention.

FIG. 2 shows a generalized schematic diagram of a DC power contactor in accordance with the present invention for use in a system such as that of FIG. 1 as elements 11, 21, or 14. The primary current carrying means is an electromechanical contactor having contacts 30 and 31, relay armature 32 and coil circuit 33 which may be in accordance with conventional design. The coil circuit 33 for the relay is actuated conventionally through contacts for closing or tripping the relay from a DC source 34. The main relay contacts 30 and 31 are connected to arc detection and quenching circuitry 40 in accordance with this invention. The high voltage polarity on the contacts 30 and 31 at the instant of opening can be in either direction in accordance with the practice of this invention. In the arc detection part of the circuitry, there is a full wave signal bridge 42 for developing a single polarity signal regardless of voltage polarity or current polarity at the contacts 30 and 31. The signal bridge has outputs to a series voltage regulator 44 and to a contact status sensing and logic circuit 46. The sensing and logic circuit 46 has an input from the voltage regulator 44. The voltage regulator 44 and circuit 46 have outputs to portions of the commutating portion of the circuit to be described.

In the commutation portion of the circuit there is a full wave commutation bridge 48 connected from the power contacts. Similar to the signal bridge 42, the commutation bridge 48 allows the circuit to function properly for either positive or negative current flow in the contacts 30 and 31. The commutation bridge 48 has an output to a commutation circuit 50 which in turn supplies an input to the commutation bridge 48. The commutation circuit 50 also has inputs from SCR gating circuits 52 and from a commutation ready circuit 54 generally connected as shown.

When the relay is closed, there is no voltage and no arc across the contacts 30 and 31. Upon opening of the main power contacts 30 and 31, the bridge circuits 42 and 48 have a voltage impressed upon them in accordance with the polarity occuring at the contacts. When an arc voltage is detected, the circuit 46 brings about the gating of the SCR gating circuits 52 to commutate the load energy out of the electromechanical contacts 30 and 31 long enough to ensure that a reapplied voltage will not reignite the arc. Then, the commutation ready circuit 54 ensures full commutation capability for a subsequent contact opening. The circuit 46 waits until commutation is complete to energize the commutation circuit 50 to bring the commutation energy back to the level prior to opening.

The contact status sense and logic circuit 46 includes a time delay means which, upon detection of opening contacts and arc initiation, begins a fixed delay which allows the contact operating mechanisms to complete opening the contact gap between armature 32 and contacts 30 and 31. The physical separation is required to guarantee the arc will remain extinguished after commutation.

After this initial time delay, the SCR's in the commutation circuit 50 are gated through the SCR gating circuits 52 by signals from the contact status sense and logic circuit 46, which provides a path for energy stored in a commutation capacitor within the commutation circuit 50. The current through the contactor is reduced to zero by the capacitor energy which extinguishes the arc. At the completion of the current pulse from the commutation circuit 50, the SCR's stop conduction.

Further time delay influences the operation of the commutation ready circuit 54 to ensure the commutation is complete before recharging the capacitor in circuit 50. The capacitor is recharged to supply potential for the next commutation cycle. A trickle charge is used to maintain capacitor charge for a steady state operation. This feature of providing a precharge on the commutation capacitor to line voltage that occurs shortly after a previous commutation cycle is a significant feature of the present invention. This action allows for a rapid cycle capability and the capability to operate with reduced input voltage during a severe overload.

A further significant feature is that the full wave signal bridge 42 and the full wave commutation bridge 48 allow the commutation circuit to work properly for either polarity of current flow and yet, of course, the circuit only requires one set of commutation components, the SCR's and commutation capacitor, which due to their size, is an important consideration.

Voltage transients generated during commutation are minimal due to the configuration of the "steering" full wave bridge. Capacitor current in excess of the load current is directed through the bridge diodes which maintains the load voltage at a maximum of the input supply. This operating characteristic will improve the reliability of applied loads.

A further favorable feature is that the arc detection and quenching circuitry herein can be utilized on a variety of different contactor types without limitation as to single throw or double throw contactors or the like.

A more specific and preferred embodiment of the invention will now be described with reference to FIG. 3 where circuit portions are identified by reference numerals used in the description of the block diagram of FIG. 2.

Figure 3:
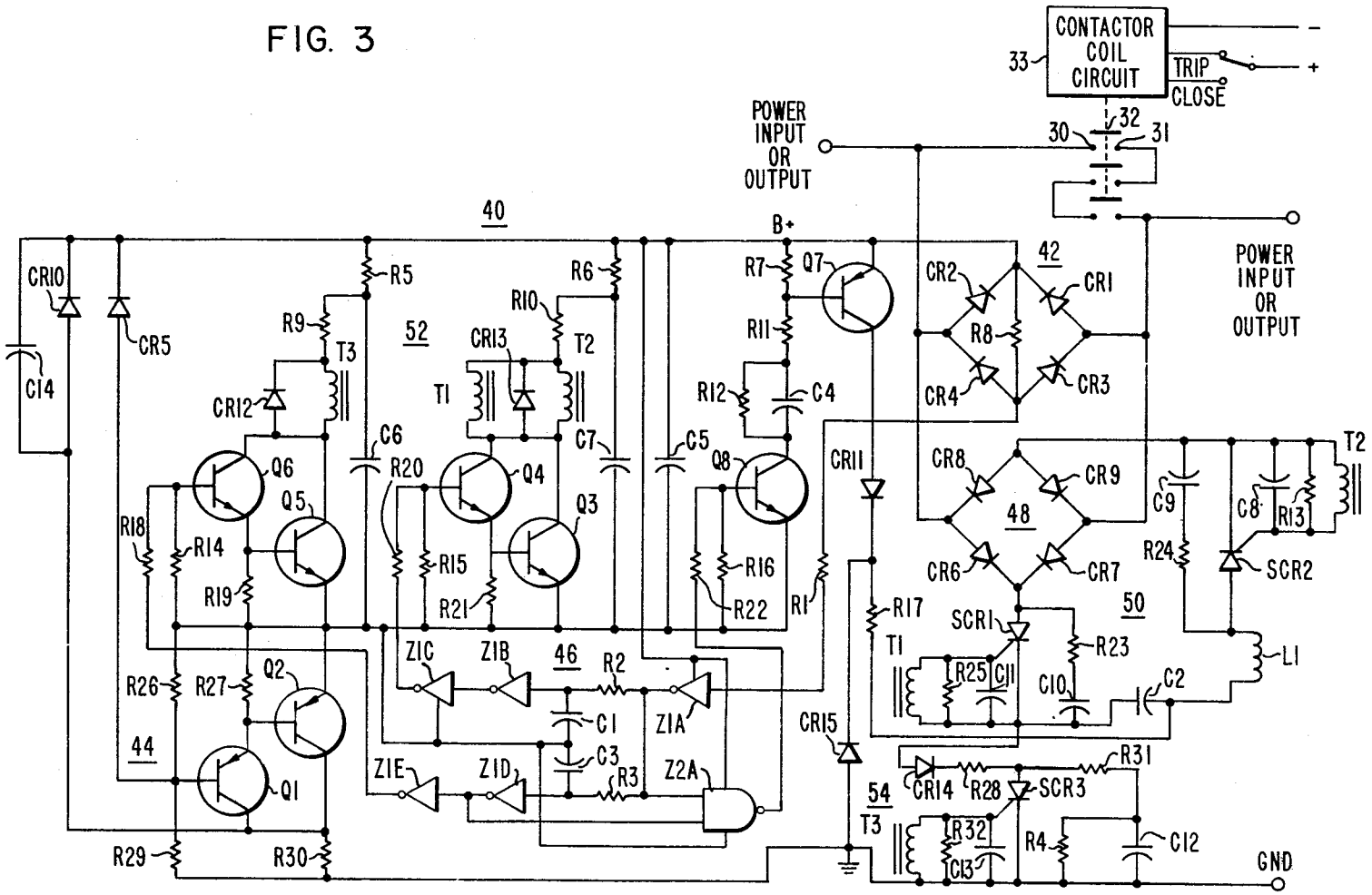
FIG. 3 is a circuit schematic of an embodiment of the present invention.

FIG. 3 shows a contactor utilizing a conventional three-phase, latch-type, aircraft circuit breaker with three main pairs of contacts 30 and 31 connected in series. This mechanism provides sufficient steady state gap for voltage breakdown protection when open and offers very fast operation times to minimize arc duration. However, other breaker mechanisms can be utilized with the arc detection and quenching circuit to be described.

A series voltage regulator 44 for providing a regulated DC supply voltage referenced to the line voltage comprises as principal components transistors Q1 and Q2 and zener diode CR5, which along with associated components, provide power to the logic and gating circuits 46 and 52. Reference may be made to copending application Ser. No. 965,553, filed Dec. 1, 1978 by K. C. Shuey and assigned to the present assignee for further description of suitable voltage regulators of alternate type that are preferred to get lower power dissipation. In operation, with the contacts 30 and 31 closed and the initiation of opening with an inductive load it is characteristic, with silver contacts open enough to draw more than 0.5 ampere an arc will start, and as the contacts separate, the voltage across the arc continues to increase. The magnitude of the voltage depends on the nature of the contact surface, but typically will be greater than 12 volts per contact arc. With the six gaps in series in the illustrated embodiment, a DC voltage of at least 72 volts is present when the arcs begin. This voltage is sensed by the full wave signal bridge 42 comprising diodes CR1, CR2, CR3, and CR4. The bridge applies a signal to inverter gate Z1A in the contact status sense and logic circuit portion 46. The output from Z1A is fed through a time delay circuit comprising resistor R2 and capacitor C1 to ensure sufficient separation of the contacts before commutation is started; thus preventing arc reignition after commutation is complete. Logic gates Z1B and Z1C cause a squared off signal to be applied to the SCR gating circuit 52 which comprises transistors Q3, Q4, transformer elements T1 and T2 and the incidental associated components.

Commutation capacitor C2 in the commutation circuit portion 50 has been charged to the line voltage prior to contact opening. When transistors Q3 and Q4 of the gating circuit 52 saturate, a current pulse is sent to the gates of SCR1 and SCR2 simultaneously, allowing them to conduct. The commutation tank circuit composed of commutation capacitor C2 and inductor L1 functions to provide a half cycle sinusoid of current through the SCR's 1 and 2 and the full wave commutation bridge 48 comprising diodes CR6, CR7, CR8, and CR9. When the current through C2 reaches the load current magnitude, the contact current is 0; and the arc discontinues and the contact voltage is 0. The load current is supplied through the commutation path until the commutation current is below the load current level. When this occurs, the contact voltage reappears at supply level and the load is shut off at a rate controlled by the sinusoidal current. At the completion of commutation, capacitor C2 is charged to line potential in the opposite polarity.

The commutation ready circuit portion 54 now comes into play. The time delay in circuit portion 46 provided by resistor R3 and capacitor C3 in conjunction with gates Z1D, Z1E and Z2A combine to provide the logic for recharging. The time delay is of sufficient length to ensure that the load has been completely commutated before the turn-around of polarity of charge on C2 is initiated. After the time delay, SCR3 is gated through transformer T3 and transistors Q5 and Q6. Simultaneously, transistor Q7 is saturated by base current provided through transistor Q8. The result of the conduction of SCR3 and transistor Q7 is that capacitor C2 is now charged back to the proper voltage and polarity, ready for commutation. Resistor R4 is included to maintain a charge on C2 after SCR3 is naturally commutated off. This recharge circuit allows the open/close cycle rate of the contactor to be quite fast.

When the contacts close, the full wave signal bridge has 0 volts across it. This level allows the output Z1A to go low and sets up the gate drive circuits 52 for a subsequent commutation cycle.

Figure 4:
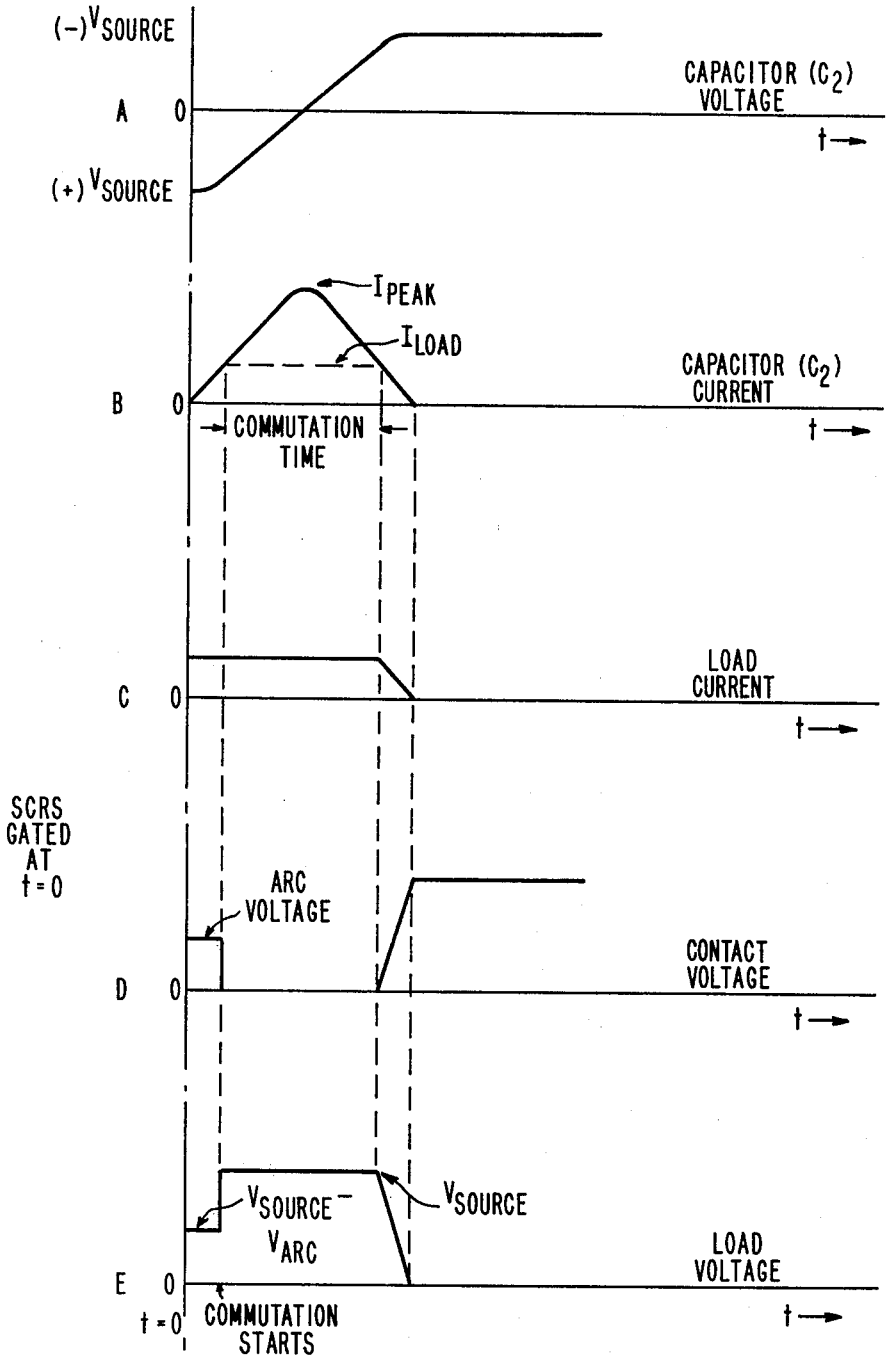
FIG. 4 is a set of waveforms illustrating operation of the circuitry of FIG. 3.

Referring to FIG. 4, commutation wave forms for the contactor circuitry are illustrated. There are shown the variations with time of the capacitor voltage in part A, the capacitor current in part B, the load current in part C, the contact voltage in part D, and the load voltage in part E, over a commutation cycle.

The following table of components is provided as a more complete exemplary embodiment of the invention in connection with the illustrated circuitry of FIG. 3 and is suitable for a high voltage DC contactor having capability up to at least about 270 to 300 volts DC.

TABLE OF COMPONENTS

| Integrated Circuits | | |
|---|---|---|
| Z1 | MC/14572 | |
| Z2 | MC/14011 | |
| **Resistors (all ½ watt except as stated)** | | |
| R1 | 10 MEG | ohms |
| R2 | 47 K | " |
| R3 | 270 K | " |
| R4 | 220 K | " |
| R5 | 10 K | " |
| R6 | 10 K | " |
| R7 | 20 K | " |
| R8 | 10 MEG | " |
| R9 | 10 | " |
| R10 | 7.5 | " |
| R11 | 510 | " |
| R12 | 5.1 K | " |
| R13 | 51 | " |
| R14 | 30 K | " |
| R15 | 30 K | " |
| R16 | 30 K | " |
| R17 | 375 | " (2 watts) |
| R18 | 15 K | " |
| R19 | 1 K | " |
| R20 | 15 K | " |
| R21 | 1 K | " |
| R22 | 15 K | " |
| R23 | 5 | " |
| R24 | 5 | " |
| R25 | 51 | " |
| R26 | 47 K | " |
| R27 | 1 K | " |
| R28 | 120 | " (50 watts) |
| R29 | 150 K | " |
| R30 | 5.1 K | " (2 watts) |
| R31 | 5 | " |
| **Diodes** | | |
| CR1, 2, 3, 4 | 1N649/600v | |
| CR5 | 15 v., mw | |
| CR6, 7, 8, 9 | 1N1190R/600v | |
| CR10 | 250 volt, 1 watt | |
| CR11, 14, 15 | IN4007 | |
| CR12, 13 | IN4001 | |
| **Capacitors** | | |
| C1 | .022μf/35v TANT | |
| C2 | 20μf, 600 volt (non-polarized) | |
| C3, 5 | 1μf/35v TANT | |
| C4 | 6.8 f/55v TANT | |
| C6, 7 | 22μf/35v TANT | |
| C, 11, 13 | .01μf/50v CER | |
| C9, 10, 12 | .068, 600v | |
| C14 | | |
| **Transistors** | | |
| Q1 | MPSA92 | |
| Q2, 7 | 2N6214 | |
| Q3, 5 | 2N3583 | |
| Q4, 6, 8 | 2N3019 | |
| **SCR's** | | |
| SCR1, 2 | WT500 | 600-800 volt |
| SCR3 | 2N690 | 600 volt |

The specific circuitry employed may be varied in accordance with the skill of the art in relation to a particular application. Some variations of preferred embodiments in accordance with this invention include the following:

(1) Modification of the voltage regulator 44 from series to switching configuration to reduce power dissipation significantly.

(2) Modification of the circuit (or commutation ready) 54 to replace SCR3 with a transistor circuit thereby gaining better definition of circuit shut-off characteristics.

(3) Modification of control supply voltage to allow proper operation with reduced input voltage for extended periods such as by use of a filter to maintain the regulated supply voltage for approximately 0.5 sec. upon occurrence of a reduced supply voltage.

(4) Introducing a clamp (e.g. using Zener diodes) on the commutation capacitor voltage which controls the maximum commutation current, allowing optimum selection of commutation components.

It will be apparent that numerous additional changes can be made in keeping with the invention.

We claim:

1. A high voltage DC contactor with solid state arc quenching comprising:

a pair of contacts;

a movable armature for selectively connecting said contacts together;

first rectifier means connected across said contacts for providing a rectified signal indicating initiation of arcing upon opening of said contacts;

second rectifier means connected across said contacts for commutating unidirectional voltage into and out of said contacts;

time delay circuit means responsive to said signal from said first rectifier means to provide a time delayed signal;

static switching means responsive to said time delayed signal to provide a conductive path through said second rectifier means to said contacts;

a commutation capacitor connected to discharge across said contacts when said static switching means provides said conductive path, said second rectifier means applying stored energy from said capacitor in opposition to the arc initiating voltage at said contacts to extinguish the arc;

means for readying said commutation capacitor for further operation by charging up said capacitor following a predetermined time delay after its discharge.

2. The subject matter of claim 1 wherein: said first and second rectifier means are each a full wave rectifier bridge.

3. A high voltage DC contactor with solid state arc quenching comprising:

a pair of contacts and a movable contact armature;

a commutation circuit connected across said contacts comprising a full wave rectifier bridge, a commutation capacitor connected across said full wave rectifier bridge and means for initiating and terminating the discharge of energy from said capacitor into said full wave rectifier bridge during the opening of said contacts and armature.

4. The subject matter of claim 3 further comprising: means for maintaining a charged condition on said capacitor during periods in which said contacts and armature are closed.

5. The subject matter of claim 4 wherein: said means for maintaining a charged condition on said capacitor comprises a charging circuit for rapidly charging said capacitor to line voltage.

* * * * *